US006654972B1

(12) United States Patent
Loyd et al.

(10) Patent No.: US 6,654,972 B1
(45) Date of Patent: Dec. 2, 2003

(54) WATER RECREATIONAL APPARATUS WITH ROTATING FILTER DOORS

(75) Inventors: Casey Loyd, Pomona, CA (US); Pedro Vargas, Pomona, CA (US)

(73) Assignee: California Acrylic Industries, Inc., Pomona, CA (US)

( * ) Notice: Subject to any disclaimer, the term of this patent is extended or adjusted under 35 U.S.C. 154(b) by 0 days.

(21) Appl. No.: 10/268,221

(22) Filed: Oct. 9, 2002

(51) Int. Cl.[7] ..... E04H 4/00

(52) U.S. Cl. ..... 4/507; 4/541.1

(58) Field of Search ..... 4/507–509, 541.1, 4/541.5, 488, 904; 210/169

(56) References Cited

U.S. PATENT DOCUMENTS

| | | | | |
|---|---|---|---|---|
| 4,903,352 A | * | 2/1990 | Murakami | 4/541.3 |
| 5,367,719 A | * | 11/1994 | Mermelstein | 4/488 |
| 5,758,369 A | * | 6/1998 | Takahashi et al. | 4/488 |
| 6,214,217 B1 | * | 4/2001 | Sliger, Jr. | 210/169 |

* cited by examiner

*Primary Examiner*—Charles E. Phillips
(74) *Attorney, Agent, or Firm*—Sheldon & Mak; Denton L. Anderson

(57) ABSTRACT

A water recreational apparatus has a water basin, a filter and a pump. The side walls of the water basin have side doors to allow the flow of water from the water basin to the filter. A spring or other biasing means is provided to bias the side wall doors to a closed position when the pump is not operating, but allowing the side doors to open when the pump is operating.

6 Claims, 2 Drawing Sheets

WATER RECREATIONAL APPARATUS WITH ROTATING FILTER DOORS

FIELD OF THE INVENTION

This invention relates generally to water recreational apparatuses, and more specifically, to water recreational apparatuses having a filtering system.

BACKGROUND OF THE INVENTION

Water recreational apparatuses, such as portable spas, hot tubs, above ground pools and water recirculating bath tubs have become very popular. Many such water recreational apparatuses have water filters wherein a portion of the water within the basin is withdrawn via a filter opening, filtered to remove suspended debris and reintroduced into the water basin.

In conventional water recreational apparatuses of the prior art, the filter opening is typically a spill way defined in the uppermost portion of one of the side walls of the apparatus. The problem with this spill way configuration is that the only water in the apparatus that is filtered is water at the very upper level in the apparatus. Also, the spill way configuration takes up space and does nothing to add to the overall aesthetic appearance of the apparatus.

Accordingly, there is a need for a water recreational apparatus which overcomes these problems in the prior art.

SUMMARY OF THE INVENTION

The invention satisfies this need. The invention is a water recreational apparatus comprising (a) a water basin having side walls and a bottom wall, (b) a filter disposed external of the basin, (c) a pump having a suction side and a discharge side, (d) suction side water circulation lines serially connecting the water basin, the filter and the suction side of the pump, and (e) discharge side water circulation lines connecting the discharge side of the pump and the water basin. In the invention, the side walls comprise one or more side wall doors to allow the flow of water from the water basin to the suction side water circulation lines, the one or more side walls being movably affixed to the basin so that they can move between a closed position and an open position. Also in the invention, the water circulation apparatus further comprises biasing means to bias the one or more side wall doors to the closed position when the pump is not operating, but allowing the one or more side wall doors to move toward the open position when the pump is operating.

DESCRIPTION OF THE DRAWINGS

These and other features, aspects and advantages of the present invention will become better understood with reference to the following description, appended claims and accompanying drawings where:

DETAILED DESCRIPTION

Figure 2:
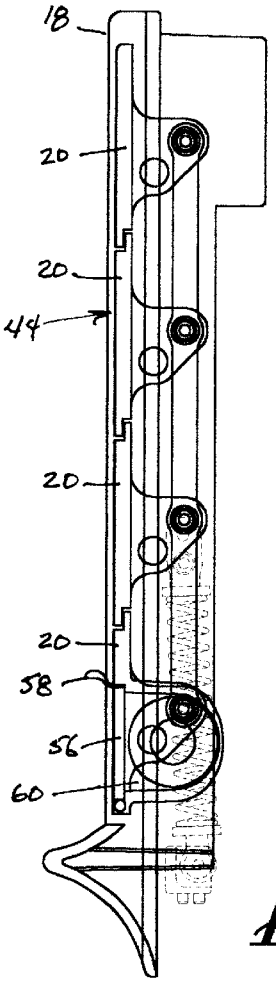
FIG. 2 is a cross-sectional side view detail of a side wall of the water recreational apparatus illustrated in FIG. 1.
Figure 1:
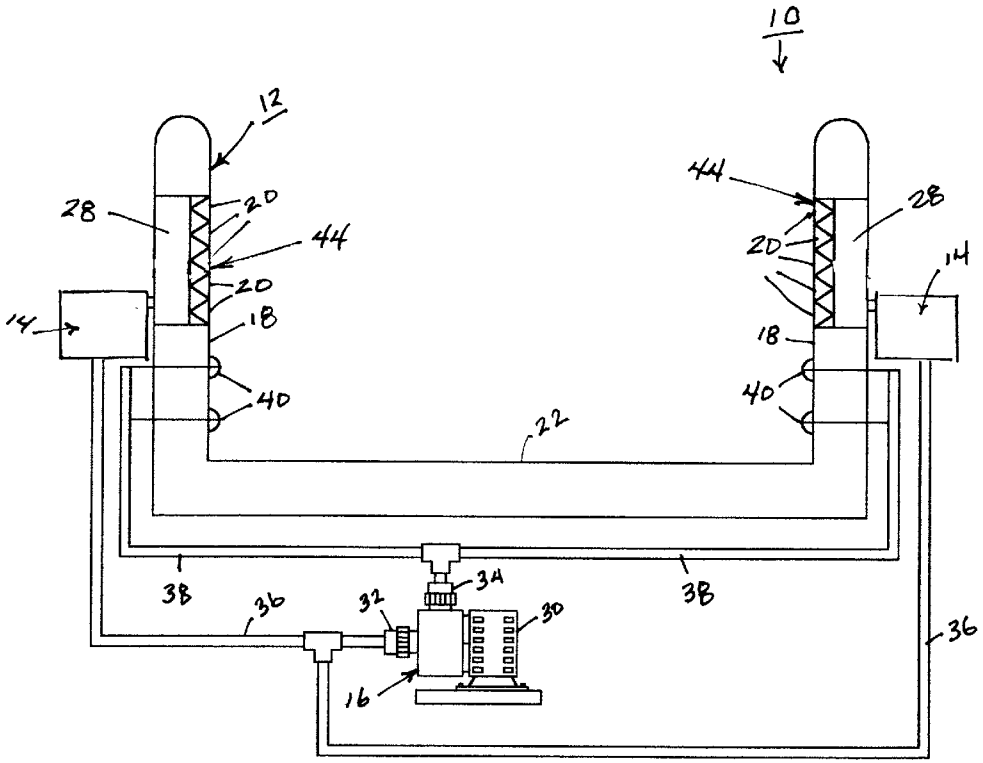
FIG. 1 is a diagrammatic side view of a water recreational apparatus having features of the invention.
Figure 3A:
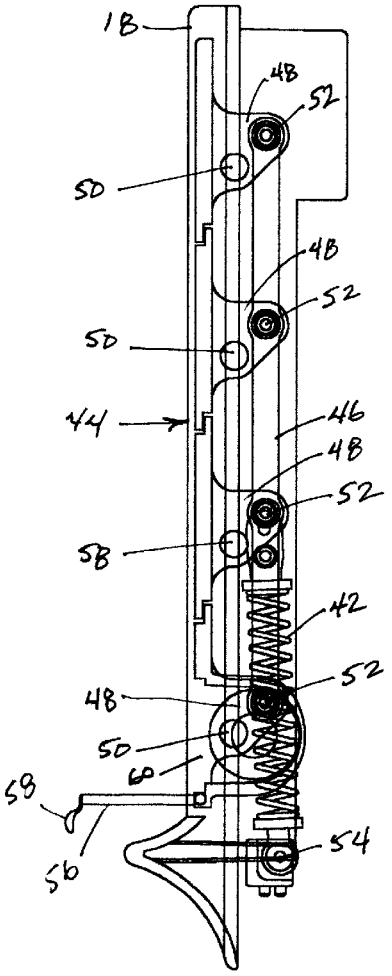
FIG. 3A is a cross-sectional side view detail of a side wall of the water recreational apparatus illustrated in FIG. 1 showing a biasing spring in its fully extended position and an access cover in its open position.
Figure 3B:
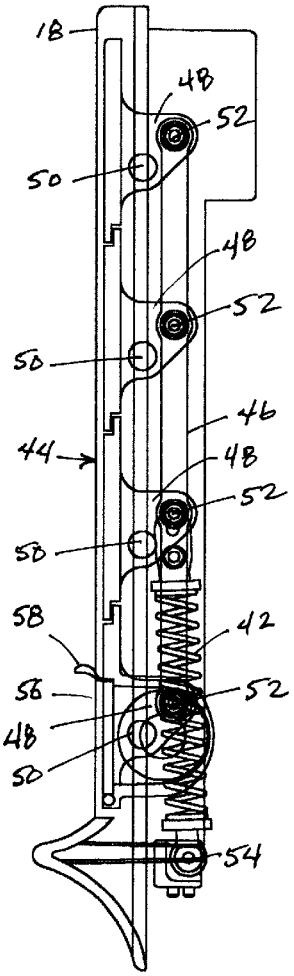
FIG. 3B is a cross-sectional side view detail of a side wall of the water recreational apparatus illustrated in FIG. 1 showing a biasing spring in its fully extended position and an access cover in its closed position.
Figure 3C:
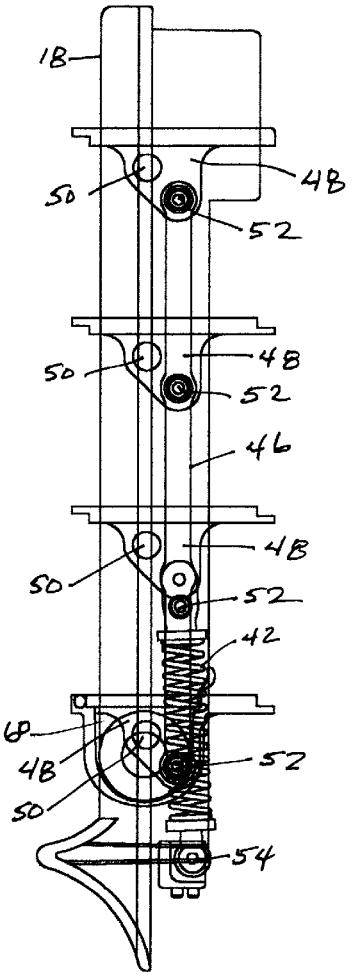
FIG. 3C is a cross-sectional side view detail of a side wall of the water recreational apparatus illustrated in FIG. 1 showing a biasing spring in its fully compressed position.

The following discussion describes in detail one embodiment of the invention and several variations of that embodiment. This discussion should not be construed, however, as limiting the invention to those particular embodiments. Practitioners skilled in the art will recognize numerous other embodiments as well.

The invention is a water recreational apparatus 10 comprising a water basin 12, a filter 14 and a pump 16. In the invention, one or more of the side walls 18 of the water basin 12 comprise one or more side wall doors 20 to allow the flow of water from the water basin 12 to the filter 14.

The water recreational apparatus 10 can be a portable spa, hot tub, above ground pool or recirculation bath tub or similar device. The water basin 12 typically has a plurality of side walls 18 and a bottom wall 22.

The filter 14 is typically disposed external of the water basin 12. The filter 14 has an upstream side 24 and a downstream side 26. The upstream side 24 of the filter 14 is connected to the water basin 12 by a filter inlet chamber 28.

The pump 16 is typically a centrifugal pump, driven by an electric motor 30. The pump 16 has a suction side 32 and a discharge side 34. The suction side 32 of the pump 16 is connected via suction side circulation lines 36 to the downstream end of the filter 14. The discharge side 34 of the pump 16 is connected via discharge side circulation lines 38 to inlet openings 40 disposed in the side walls 18 of the water basin 12. The inlet openings 40 are typically air/water spa jets.

The one or more side wall doors 20 provide access from the interior of the water basin 12 to the filter inlet chamber 28. The one or more side wall doors 20 are moveably affixed to the water basin 12 so that they can move between a closed position and an open position. When in the closed position, the side wall doors 20 are substantially flush with the side walls 18 of the water basin 12 and substantially no water can flow from the water basin 12 to the filter inlet chamber. When the side wall doors 20 are in the open position, the side wall doors 20 are substantially horizontal with respect to the side walls 18 of the water basin 12 and water can flow freely from the water basin 12, into the filter inlet chamber 28 and then into the filter 14.

Biasing means 42 are provided to bias the one or more side wall doors 20 to the closed position when the pump 16 is not operating. The biasing means 42 are configured, however, to allow the one or more side wall doors 20 to move toward the open position when the pump 16 is operating.

In the embodiment illustrated in the drawings, the one or more side wall doors 20 comprise a pair of side wall banks 44 disposed on opposite sides of the water basin 12. Each side wall bank 44 has a plurality of side wall doors 28 disposed in vertical relationship with one another. Each of the side wall doors 20 is rotatably affixed to the water basin 12 in such a way that each side wall door 20 can rotate between its open position and its closed position. Each side wall door 20 is linked to a side wall door connection rod 46 which is moveable in a substantially vertical direction such that the movement of the connection rod 46 in a substantially vertical direction rotates each of the side wall doors 20 in unison between its closed position and its open position. In the embodiment illustrated in the drawings, each of the side wall doors 20 is rotatably affixed to the water basin 12 by a cam plate 48 having a pivot axis 50 and a connection rod attachment axis 52. As can be seen in the drawings, the upward movement of the connection rod 46 rotates each of the side wall doors 20 towards the closed position, whereas the downward movement of the connection rod 46 rotates each of the side wall doors 20 towards the open position.

In the embodiment illustrated in the drawings, the biasing means 42 is provided by a coil spring which is attached to the connection rod attachment axis 52 on the cam plate 48 of the lowermost side wall door 20. The lower end of the coil spring is attached to a fixed attachment element 54 disposed below the lowermost side wall door 20. The coil spring is chosen such that each of the side wall doors 20 in the bank 44 of the side wall doors 20 is biased to the closed position when the pump 16 is not operating, but allowing the plurality of side wall doors 20 to rotate towards the open position when the pump 16 is operating. In one embodiment, the coil spring has an outside diameter of about 12 mm, an inside diameter of about 9.42 mm and an overall length (when uncompressed) of about 64.5 mm.

Other biasing means can also be used such as other forms of springs. The biasing means can also be a complex electronic biasing means (not shown) which include servomotors to open and close the side wall doors 20, door monitoring means to monitor the position of each side wall door 20, flow monitoring means to monitor the flow of water through the water circulation lines 36 and 38 and/or an electronic controller.

The lowermost side wall door 20 in one or all of the side wall banks 44 further comprises an access cover 56 which can be opened by hand by tugging on a strap 58 disposed along the top of the access cover 56. Behind the access cover 56 is a tablet compartment 60 wherein various chemical tablets, such as chlorine tablets or bromine tablets, can be retained for treating water flowing through the lowermost side wall door 20.

The invention provides a water recreational apparatus which eliminates the necessity of a filter spillway. Accordingly, the spa of the invention is more efficient with respect to its top side space and is more aesthetically pleasing with respect to its appearance.

Having thus described the invention, it should be apparent that numerous structural modifications and adaptations may be resorted to without departing from the scope and fair meaning of the instant invention as set forth hereinabove and as described hereinbelow by the claims.

What is claimed is:

1. A water recreational apparatus comprising:

(a) a water basin having side walls and a bottom wall;

(b) a filter disposed external of the basin;

(c) a pump having a suction side and a discharge side;

(d) suction side water circulation lines serially connecting the water basin, the filter and the suction side of the pump; and (e) discharge side water circulation lines connecting the discharge side of the pump and the water basin;

wherein the side walls comprise at least one opening having a side wall door to allow the flow of water from the water basin to the suction side water circulation lines, the at least one side wall door being movably affixed to the basin so as to close the at least one opening or open the at least one opening, to the suction lines; and wherein the water circulation apparatus further comprises biasing means to bias the at least one side wall door to the closed position when the pump is not operating, but allowing the at least one side wall door to move toward the open position when the pump is operating.

2. The water recreational apparatus of claim 1 wherein the biasing means is a spring.

3. The water recreational apparatus of claim 1 wherein the one or more side wall doors comprise a plurality of doors disposed in vertical relationship with respect to one another.

4. The water recreational apparatus of claim 3 wherein each of the side wall doors is rotatably affixed to the basin, and wherein each side wall door is linked to a rod which is moveable in a substantially vertical direction such that the movement of the rod in a substantially vertical direction rotates each of the doors in unison between its closed position and its open position.

5. The water recreational apparatus of claim 4 wherein the biasing means is a spring attached to the rod.

6. A water recreational apparatus comprising:

(a) a water basin having side walls and a bottom wall;

(b) a filter disposed external of the basin;

(c) a pump having a suction side and a discharge side;

(d) suction side water circulation lines serially connecting the water basin, the filter and the suction side of the pump; and (e) discharge side water circulation lines connecting the discharge side of the pump and the water basin;

wherein the side walls comprise a plurality of side wall doors to allow the flow of water from the water basin to the suction side of the circulation lines, the plurality of side wall doors being disposed in vertical relationship with respect to one another and being rotatably affixed to the basin so that they can rotate in unison between a closed position and an open position, each side wall door being linked to a rod which is movable in a substantially vertical direction such that the movement of the rod in a substantially vertical direction rotates each of the doors between its closed position and its open position; and wherein the water circulation apparatus further comprises a spring attached to the rod to bias the plurality of side wall doors to the closed position when the pump is not operating, and allowing the plurality of side wall doors to rotate toward the open position when the pump is operating.

* * * * *